US007102296B1

(12) United States Patent
Munter et al.

(10) Patent No.: US 7,102,296 B1
(45) Date of Patent: Sep. 5, 2006

(54) SCREW-IN TRANSFORMER

(76) Inventors: Keith F. Munter, 32510 K18 South, Sioux City, IA (US) 51109; Earl F. Munter, 2315 S. Cedar St., Sioux City, IA (US) 51106

( * ) Notice: Subject to any disclaimer, the term of this patent is extended or adjusted under 35 U.S.C. 154(b) by 0 days.

(21) Appl. No.: 10/999,525

(22) Filed: Nov. 30, 2004

(51) Int. Cl.
*H05B 41/16* (2006.01)

(52) U.S. Cl. ..... 315/276; 315/206; 315/200 R; 315/57

(58) Field of Classification Search ..... 315/276
See application file for complete search history.

(56) References Cited

U.S. PATENT DOCUMENTS 2,279,635 A * 4/1942 Morley ..... 313/25
3,401,265 A * 9/1968 Dotto ..... 250/214 SW
4,187,447 A * 2/1980 Stout et al. ..... 315/85
4,518,896 A 5/1985 Miles, Jr.
5,458,505 A * 10/1995 Prager ..... 439/485
6,657,435 B1 * 12/2003 Brown ..... 324/508
6,658,774 B1 * 12/2003 Munter et al. ..... 40/574
6,946,973 B1 * 9/2005 Yanda ..... 340/932.2

* cited by examiner

*Primary Examiner*—Don Wong
*Assistant Examiner*—Binh Van Ho
(74) *Attorney, Agent, or Firm*—McKee, Voorhees & Sease, P.L.C.

(57) ABSTRACT

An apparatus for providing convenient transforming of electrical energy from a first voltage level to a second voltage level, includes a housing having an end wherein the end includes a conductive threading and a contact for making an electrical connection with a light bulb socket. The apparatus also includes a transformer electrically connected to the electrical connection for receiving power through the light bulb socket and transforming the received electrical energy from the first voltage level to the second voltage level. There is a connection electrically connected to outputs of the transformer to provide power at the second voltage level. The converted power can be used to power a DC-driven device such as an LED.

15 Claims, 4 Drawing Sheets

SCREW-IN TRANSFORMER

BACKGROUND OF THE INVENTION

The present invention relates to providing convenient access to power. More particularly, but without limitation, the present invention relates to providing a screw-in transformer for accessing a voltage source through a light bulb socket and converting the voltage to a different level through use of a transformer or related circuitry.

BRIEF SUMMARY OF THE INVENTION

According to one aspect of the present invention, a screw-in transformer is provided. The screw-in transformer is an apparatus for providing convenient transforming of electrical energy from a first voltage level to a second voltage level. The apparatus includes a housing having an end wherein the end includes a conductive threading and a tip for making electrical connection with a light bulb socket. There is a transformer electrically connected to the electrical connection for receiving power to the light bulb socket and transforming received electrical energy from the first voltage level to the second voltage level. There is a connector electrically connected to the output of the transformer to provide power at the second voltage level. The connector can be of any number of types of connectors associated with providing power including a socket, a plug, a mini-adaptor, a wired or other type of connector.

According to another aspect of the invention, the apparatus includes a DC-driven device such as, but not limited to an LED light, a fan, or other DC-driven device. The DC-driven device is powered by a DC voltage provided by or through the transformer.

DETAILED DESCRIPTION OF THE PREFERRED EMBODIMENT

The present invention provides for a screw-in transformer to preferably be used with a light bulb socket. The light bulb socket provides a typical household voltage such as 110 VAC. The present invention provides for access to power available through the light bulb socket by transforming the power to a useful voltage level. The present invention provides for DC power to be provided by a transformer electrically connected to a light bulb socket. The screw-in transformer can be used to provide DC power from a light bulb socket to LED displays. U.S. Pat. No. 6,658,774 is herein incorporated by reference in its entirety. Alternately the DC power can be used for other purposes and can power any number of DC devices or can merely be made available through a connector. Instead of supplying a DC voltage, an AC voltage at a different voltage level can also be supplied.

Figure 1:
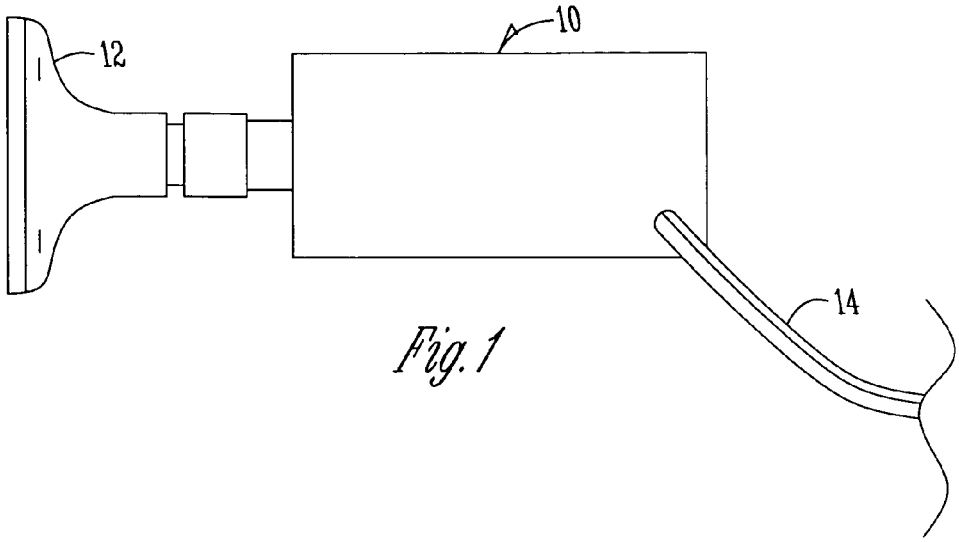
FIG. 1 is a view of one embodiment of a screw-in transformer of the present invention electrically connected to a light bulb socket.

FIG. 1 illustrates an apparatus 10 electrically connected to a light bulb socket 12. Extending from the apparatus 10 are a wire connection 14 that provides a DC voltage suitable for powering LED displays. Disposed within the apparatus 10 is a transformer for transforming the 110 VAC to an appropriate DC level, such as, but not limited to 12 volts.

Figure 2:
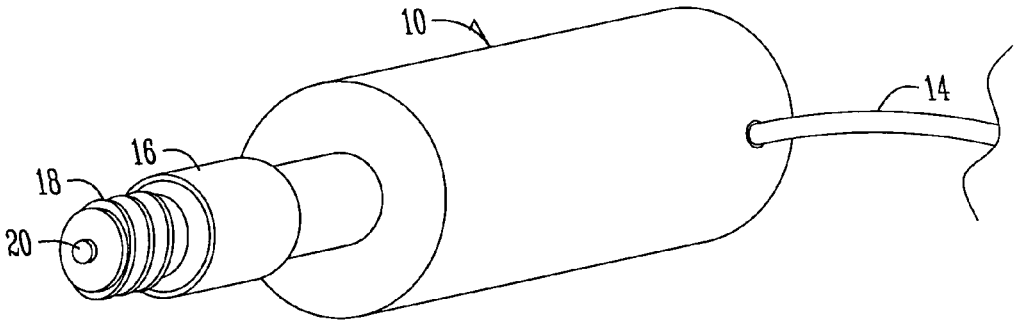
FIG. 2 is a perspective view of one embodiment of a screw-in transformer of the present invention.

FIG. 2 provides a perspective view of the apparatus 10. The apparatus 10 includes a neck 16 which terminates in a light bulb-type screw-in connector 18 with a connection 20. In typical use, the light-bulb screw-in connector 18 would provide a neutral connection and the contact 20 would provide a line connection.

Figure 3:
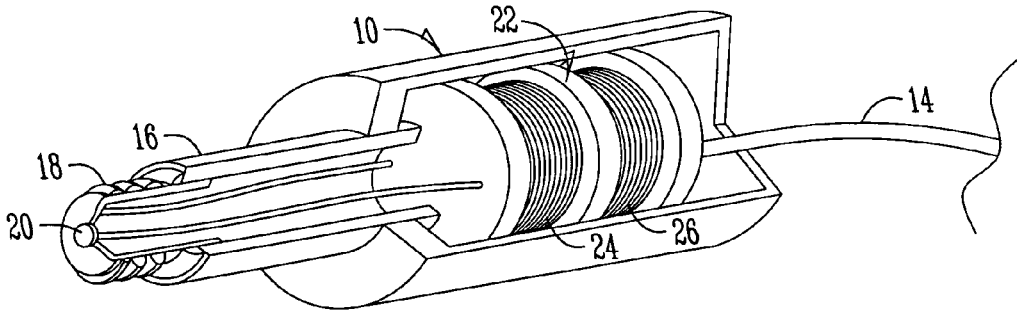
FIG. 3 is a sectional view of one embodiment of a screw-in transformer of the present invention.

FIG. 3 illustrates a sectional view of the device 10. As shown in FIG. 3, a transformer 22 is shown. The transformer includes a first inductor 24 and a second inductor 26. The present invention contemplates that the transformer 22 may be accompanied by additional electronic circuitry that may be appropriate in a particular application.

Figure 4:
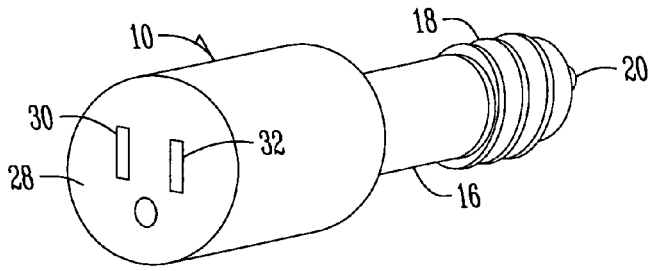
FIG. 4 is a perspective view of another embodiment of a screw-in transformer of the present invention.

FIG. 4 illustrates another embodiment of the present invention. In FIG. 4 the apparatus 10 has a neck 16 with the screw-in connector 18 with the connection 20. The device 10 of FIG. 4 includes a connector comprised of connections 30 and 32 on an opposite end 28.

Figure 5A:
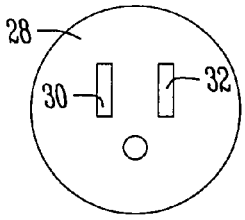
FIGS. 5A–5E illustrate some of the many types of connectors that can be used with the present invention.
Figure 5B:
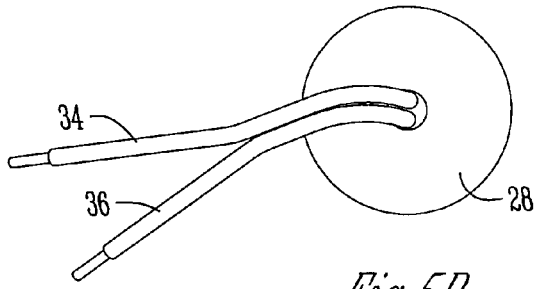
Figure 5C:
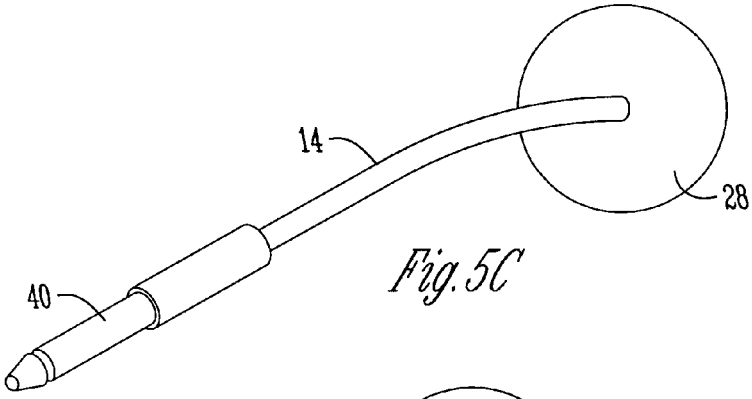
Figure 5D:
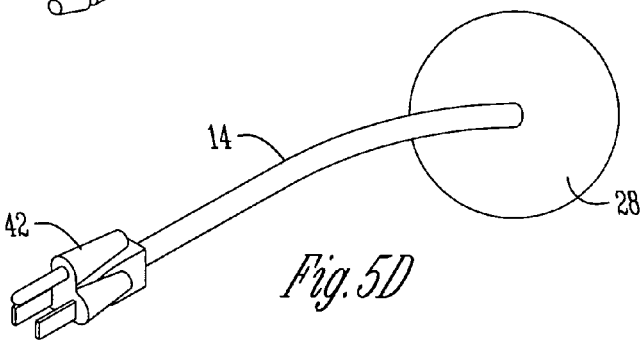
Figure 5E:
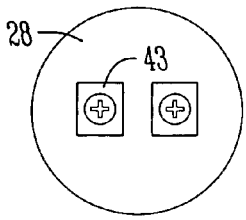
Figure 6:
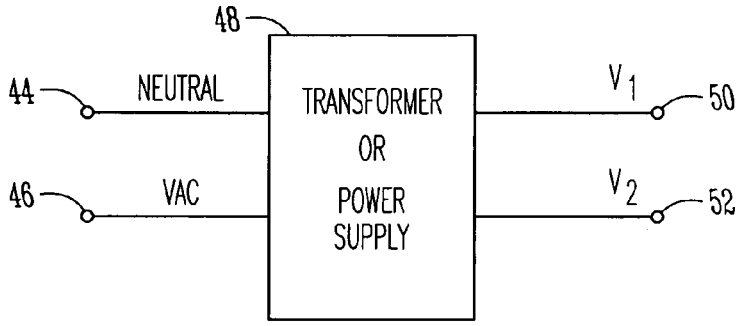
FIG. 6 is a schematic showing one embodiment of the present invention.

FIGS. 5A–5E illustrate various embodiments of the types of connections associated with the end 28. These types of connectors can include a plug receptacle having connections 30 and 32 as shown in FIG. 5A. As shown in FIG. 5B, leads 34 and 36 can extend from the end 28. As shown in FIG. 5C, a wire connection 14 can extend with a mini plug 40 on the end of the wire connections 14. As shown in FIG. 5D, a wire connection 14 can extend from the face 28 with a power plug 42 electrically connected to the wire connection 14. In FIG. 5A, a screw-in terminal is shown. The present invention contemplates that this or other types of terminals may be used. The present invention is not limited to these specific connections shown, those shown are merely representative of the many types of connections contemplated by the present invention. As shown in FIG. 6, a neutral connection 44 and a live power connection 46 are electrically connected to a transformer or power supply 48. The term "power supply" is used because the present invention contemplates additional circuitry may be used in addition to or in place of a transformer. For example, a voltage regulator may also be used to provide a regulated voltage at one or more levels. Connections 50 and 52 are output from the transformer or power supply 48. Preferably connections 50 and 52 provide for a DC voltage, where the present invention contemplates that other types of power transformation can be performed.

Figure 7:
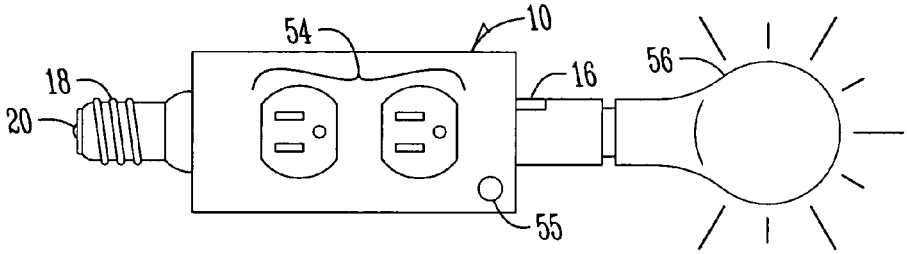
FIG. 7 illustrates one embodiment of the present invention where in addition to providing a separate power connection, a light bulb is powered.

FIG. 7 illustrates another embodiment of the present invention. As shown in FIG. 7 the device 10 includes a light bulb socket 16 for inserting a light bulb 56. The device of FIG. 7 also includes electrical outlets 54 and an LED 55. The LED 55 is powered by DC voltage provided by the transformer. The present invention also contemplates that instead of outlets 54, other types of connection may be used. The other connection can provide a DC voltage if desirable. One use of the LED 55 is that it can be used to indicate that power is on, thus if the LED 55 is lit and the light bulb 56 is not, one knows that the light bulb 56 is burned out or damaged.

Figure 8:
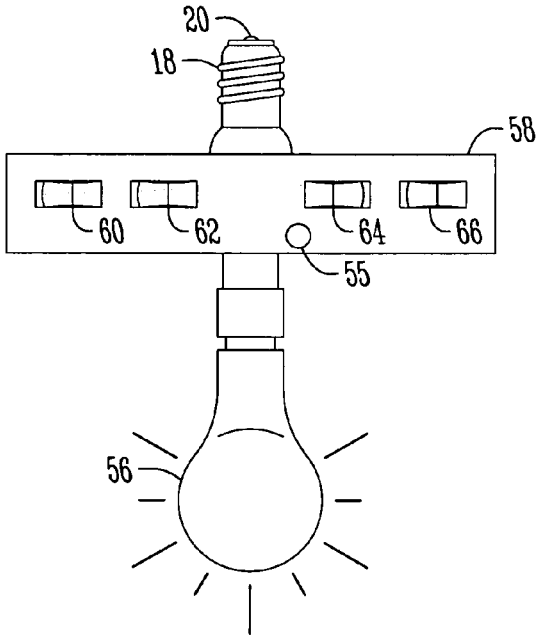
FIG. 8 is another embodiment of a screw-in transformer of the present invention where a DC-driven device is powered.

FIG. 8 illustrates another embodiment of the present invention. In FIG. 8, the transformer produces a voltage for powering a DC driven device within the apparatus 58. The DC driven device 58 can be a fan, an LED, a smoke detector or any number of types of DC driven devices. The device shown in FIG. 8 includes optional buttons 60, 62, 64 and 66 for controlling the DC-driven device and an optional LED 55. The present invention contemplates that any number of types of DC-driven devices can be included within the apparatus 58. The present invention is not limited to the particular DC driven device used.

Figure 9:
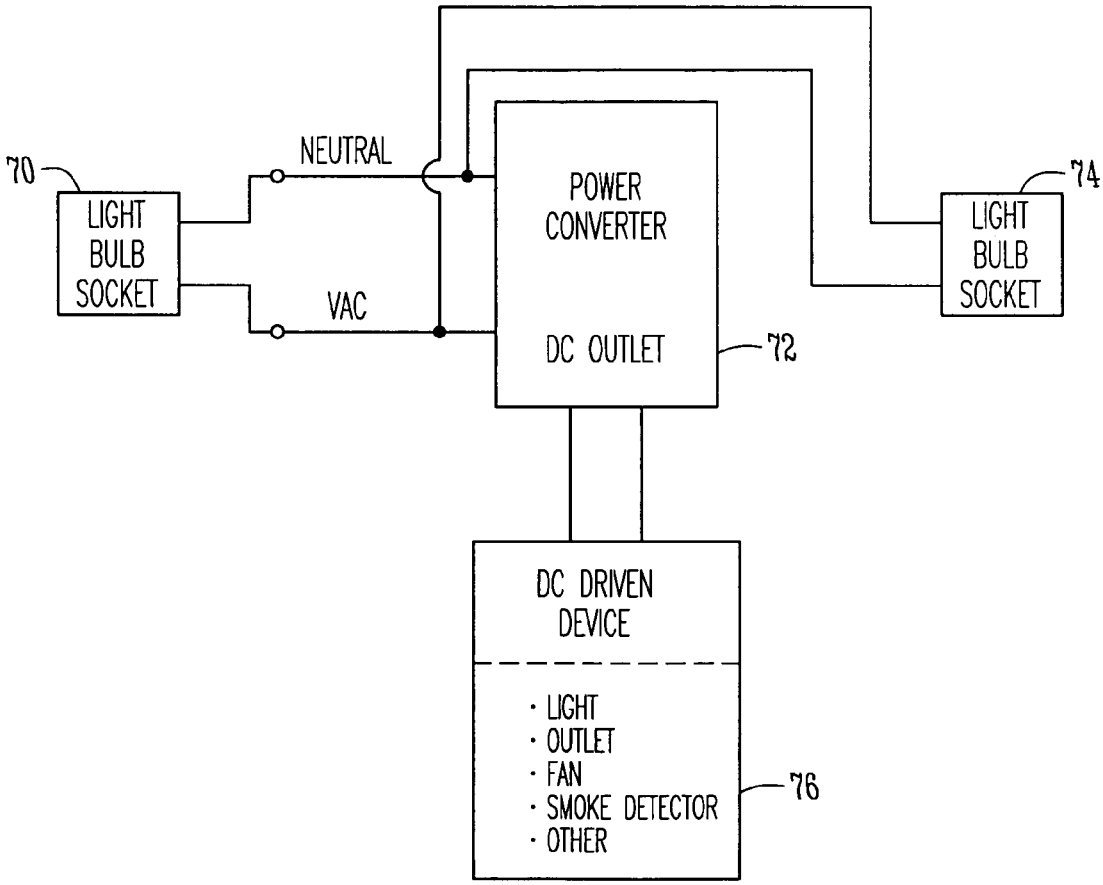
FIG. 9 is an electrical schematic for one embodiment of the present invention.

FIG. 9 is another embodiment of an electrical schematic of the present invention. In FIG. 9 a light bulb socket 70 is electrically connected to a second light bulb socket 74 as well as a power converter 72. The power converter 72 provides DC output voltage to a DC-driven device 76. The DC-driven device 76 can be a light, a fan, or smoke detector or other type of DC driven device. Where the DC-driven device is a light, the light can be a light emitting diode (LED).

Thus a screw-in transformer has been disclosed. One skilled in the art having the benefit of this disclosure will appreciate that the numerous types of connections can be supplied at various voltage levels. Also, where a voltage is supplied by the screw-in transformer, the voltage can be used for any number of purposes. These and other variations are all within the spirit and scope of the invention.

What is claimed is:

1. An apparatus for providing convenient transforming of electrical energy from a first voltage level to a second voltage level, comprising:

a housing having an end wherein the end includes a conductive threading and a contact for making an electrical connection with a light bulb socket;

a transformer electrically connected to the electrical connection for receiving electrical energy through the light bulb socket and transforming received electrical energy from the first voltage level to the second voltage level;

a connection electrically connected to outputs of the transformer to provide power at the second voltage level; and wherein the second voltage level is a DC voltage and the first voltage level is an AC voltage.

2. The apparatus of claim 1 wherein the connector is a socket for receiving a plug.

3. The apparatus of claim 1 wherein the first voltage level is 110 VAC.

4. The apparatus of claim 1 further comprising a DC-driven device disposed within the housing and electrically connected to the connection.

5. The apparatus of claim 1 wherein the connection is a plug.

6. The apparatus of claim 1 wherein the connection is a terminal.

7. A screw-in transformer comprising:

a housing having one end adapted to matingly screw into a light bulb socket to thereby make electrical contact;

a transformer within the housing adapted for electrical connection with the light bulb socket and for transforming a voltage from the light bulb socket to a second voltage level;

a connector electrically connected to the transformer for providing access to the second voltage level;

wherein the connector for providing access to the second voltage level is not a second light bulb socket.

8. The screw-in transformer of claim 7 wherein the voltage from the light bulb socket is an AC line voltage.

9. A screw-in apparatus for receiving AC line voltage through a light bulb socket and converting the AC line voltage to a DC voltage, comprising:

a housing having a threaded connection and a contact for electrical connection between the screw-in apparatus and the light bulb socket;

a power converter disposed within the housing and electrically connected to the threaded connection and the contact for receiving the AC line voltage and converting the AC line voltage to the DC voltage; and a DC-driven device disposed within the housing.

10. The screw-in apparatus of claim 9 further comprising a DC-driven device disposed within the housing.

11. The screw-in apparatus of claim 9 wherein the DC-driven device includes an LED.

12. The screw-in transformer of claim 7 wherein the second voltage level is a DC voltage.

13. The screw-in transformer of claim 7 wherein the second voltage level being used to power a LED associated with the housing.

14. The screw-in transformer of claim 7 wherein the second voltage level being used to power a fan associated with the housing.

15. The screw-in transformer of claim 7 wherein the second voltage level being used to power a smoke detector associated with the housing.

* * * * *